US011486319B2

(12) United States Patent
Xiao et al.

(10) Patent No.: US 11,486,319 B2
(45) Date of Patent: Nov. 1, 2022

(54) ENGINE WITH REMOTE THROTTLE CONTROL AND MANUAL THROTTLE CONTROL

(71) Applicant: Kohler Co., Kohler, WI (US)

(72) Inventors: Youzhi Xiao, Chongqing (CN); Xiang Li, Chongqing (CN)

(73) Assignee: KOHLER CO.

( * ) Notice: Subject to any disclaimer, the term of this patent is extended or adjusted under 35 U.S.C. 154(b) by 382 days.

(21) Appl. No.: 16/690,932

(22) Filed: Nov. 21, 2019

(65) Prior Publication Data

US 2020/0165986 A1 May 28, 2020

(30) Foreign Application Priority Data

Nov. 27, 2018 (CN) ..... 201811425238.3
Nov. 27, 2018 (CN) ..... 201821969680.8

(51) Int. Cl.
*F02D 11/02* (2006.01)
*F02D 11/06* (2006.01)
*F02D 11/10* (2006.01)

(52) U.S. Cl.
CPC ..... *F02D 11/06* (2013.01); *F02D 11/02* (2013.01); *F02D 2011/101* (2013.01)

(58) Field of Classification Search
CPC ..... F02D 9/1065; F02D 2009/0203; F02D 2009/0262; F02D 2009/0267; F02D 2011/101
USPC ..... 123/339.16, 339.28
See application file for complete search history.

(56) References Cited

U.S. PATENT DOCUMENTS 2,382,952 A * 8/1945 Armstrong ..... F02D 9/00 123/376
3,698,372 A 10/1972 Eshelman
3,700,996 A * 10/1972 Gutting ..... F02D 31/002 318/696
3,704,635 A 12/1972 Eshelman
3,750,780 A 8/1973 Danek
4,210,110 A 7/1980 Krebaum
(Continued)

OTHER PUBLICATIONS

Integrated Publishing, "Wingtip Speed Brake Control System" Source: http://navyaviation.tpub.com/14018/css/Wingtip-Type-377.htm Date Accessed: Oct. 8, 2018. (pp. 3).

*Primary Examiner* — Phutthiwat Wongwian
*Assistant Examiner* — Arnold Castro
(74) *Attorney, Agent, or Firm* — The Belles Group, P.C.

(57) ABSTRACT

A throttle assembly for an engine includes a remote control throttle lever, a manual throttle control lever, and a throttle return spring. The remote control throttle lever is configured to operate the throttle assembly and the engine based on a force received from an external device. The manual throttle control lever is configured to operate the throttle assembly and the engine based on a force received from a user input at an input portion of the manual throttle control lever. An abutment portion of the manual throttle control lever is spaced from the input portion of the manual throttle control lever and configured to abut the remote control throttle lever. The throttle return spring is configured to bias the remote control throttle lever against the abutment portion of the manual throttle control lever in an opposite direction of the force received from the external device.

20 Claims, 9 Drawing Sheets

(56) References Cited

U.S. PATENT DOCUMENTS 4,391,245 A * 7/1983 Larson ..... F02M 3/062 123/339.17
4,397,276 A 8/1983 Hayashida
4,429,591 A 2/1984 Zuch
4,502,436 A * 3/1985 Bonfiglioli ..... F02M 3/045 123/339.13
4,526,060 A * 7/1985 Watanabe ..... B60K 26/04 123/339.25
4,567,786 A 2/1986 Sakurai
4,620,575 A * 11/1986 Cuba ..... A01D 34/6806 180/307
4,660,521 A * 4/1987 Higuchi ..... F02D 31/001 123/376
4,773,371 A * 9/1988 Stenz ..... F02D 9/02 123/376
4,989,566 A * 2/1991 Wallerand ..... F02D 11/107 123/339.16
5,040,508 A * 8/1991 Watanabe ..... F02D 11/10 123/396
5,154,150 A 10/1992 Vieira
5,188,316 A 2/1993 Dressler
5,214,977 A * 6/1993 Nagafusa ..... B63H 21/22 440/84
5,215,057 A * 6/1993 Sato ..... F02D 11/10 123/399
5,261,844 A * 11/1993 Shibata ..... B63H 21/213 440/87
5,280,282 A * 1/1994 Nagafusa ..... B63H 21/213 180/287
5,367,997 A * 11/1994 Kawamura ..... F02D 11/10 123/399
5,381,770 A 1/1995 Marthaler
5,462,026 A * 10/1995 Kumagai ..... B60K 26/04 123/396
6,460,421 B1 * 10/2002 Hasegawa ..... F02D 1/045 73/862.29
6,729,298 B1 * 5/2004 Sterr ..... F02D 11/04 123/339.13
6,868,828 B2 3/2005 Kondo
7,152,580 B2 * 12/2006 Wetor ..... F02D 11/04 123/376
7,165,532 B2 * 1/2007 Steffes ..... F02D 9/02 123/376
7,213,571 B2 5/2007 Sakaguchi
7,261,280 B2 8/2007 Takano
8,567,371 B2 * 10/2013 Vaughn ..... F02D 31/00 123/376
2004/0035394 A1 * 2/2004 Gerhardy ..... F02D 11/04 123/400
2006/0162694 A1 7/2006 Sakaguchi
2007/0181100 A1 * 8/2007 Grybush ..... F02D 11/04 123/400
2011/0005024 A1 * 1/2011 Spitler ..... F02D 9/1065 15/320
2015/0176503 A1 * 6/2015 Huibregtse ..... F02D 9/1065 123/403
2018/0252168 A1 * 9/2018 Dlugi ..... F02D 9/1065

* cited by examiner

ENGINE WITH REMOTE THROTTLE CONTROL AND MANUAL THROTTLE CONTROL

CROSS REFERENCE TO RELATED APPLICATION

This application claims the benefit of priority to Chinese National Patent Application No. 201811425238.3, filed on 27 Nov. 2018 and Chinese Utility Model Application No. 201821969680.8, filed on 27 Nov. 2018, which are hereby incorporated by reference in their entireties.

FIELD

This disclosure relates in general to an engine including remote throttle control and manual throttle control, and more particularly, the interaction between a remote throttle control lever and manual throttle control lever.

BACKGROUND

Small internal combustion engines are used in a variety of devices including, but not limited to, chainsaws, lawn mowers, weed trimmers, all-terrain vehicles, wood splitters, pressure washers, garden tillers, snow blowers, or other devices. The power of the engine may be controlled by a throttle that adjusts the flow of air and/or fuel that flows to the engine. In some engines, the throttle is controlled by a manual lever operator by the user. In other engines, the throttle is controlled by a lever that is connected to another mechanism.

BRIEF DESCRIPTION OF THE DRAWINGS

Exemplary embodiments are described herein with reference to the following drawings.

DETAILED DESCRIPTION

Figure 1:
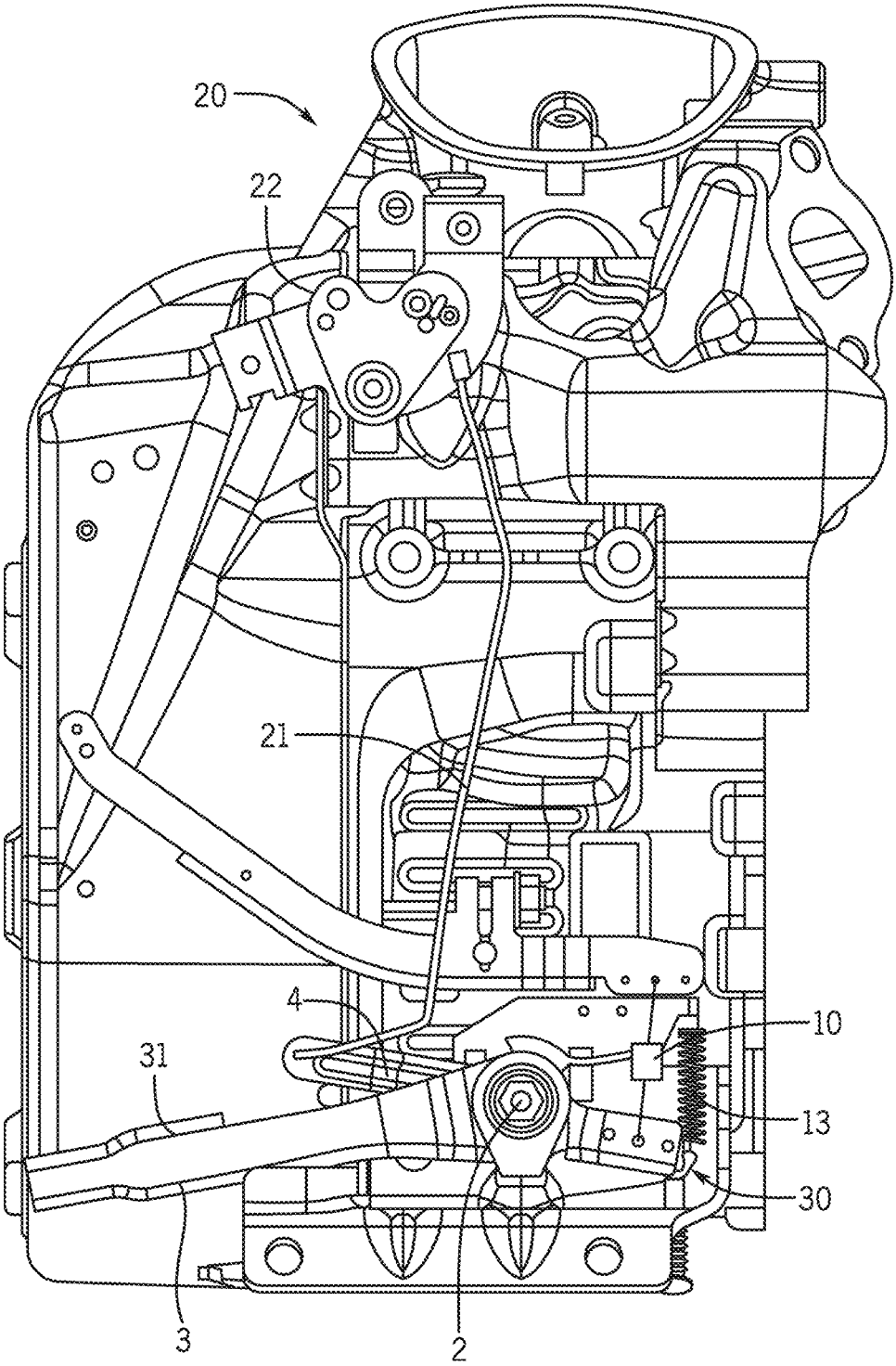
FIG. 1 illustrates an example engine with remote throttle control and manual throttle control.

FIG. 1 illustrates an example engine 20 with remote throttle control and manual throttle control. A throttle assembly 30 provides the combined remote throttle control and manual throttle control. The throttle assembly 30 may include a manual throttle control lever 3 and a remote control throttle lever 4 connected by a control lever stud 2.

The throttle adjusts the flow of air and/or fuel that flows to the engine 20. The throttle may control the flow of air flowing into the intake manifold or the flow of a mixture of air and fuel flowing into the intake manifold. The throttle may include a butterfly valve or a throttle plate that rotates to regulate the air. The valve or plate may be controlled by a mechanical coupling to the throttle assembly 30. The throttle may extend to the walls of the intake manifold. That is, the radius of a disk of the throttle may be slightly smaller than the radius of the intake manifold. Alternatively, the throttle may be spaced apart from the intake manifold such that some air can always flow around the throttle.

The remote control throttle lever 4 of the throttle assembly 30 is connected to a linkage rod 21 and a rotary bracket 22. The rotary bracket 22 may be rotated by a stepper motor, another linkage, a solenoid, or another device. A controller may operate the stepper motor or solenoid through a control signal. The rotary bracket 22 may translate rotary motion to a displacement of the linkage rod 21. The rotary bracket 22 may translate displacement in a first direction to displacement for a second direction for the linkage rod 21. The remote control throttle lever 4 controls the throttle under the direction of an external device, which may be a device outside of the engine.

As illustrated in FIG. 1, clockwise motion of the remote control throttle lever 4 may correspond to opening the throttle and counterclockwise motion of the remote control throttle lever 4 may correspond to closing the throttle. As the remote control throttle lever 4 rotates clockwise to open the throttle, tension on the throttle return spring 13 is increased. That is, the throttle return spring 13 applies a force to the remote control throttle lever 4 that tends to resist the movement of the remote control throttle lever 4 in the clockwise direction. The force of the throttle return spring 13 may be proportional to the square of the lateral distance (e.g., direction of the longitudinal axis of the remote control throttle lever 4) of the movement of the remote control throttle lever 4.

The manual throttle control lever 3 of the throttle assembly 30 includes a handle portion 31. A user may grip the handle portion 31 to rotate the manual throttle control lever 3. As illustrated in FIG. 1, clockwise motion of the manual throttle control lever 3 may correspond to opening the throttle and counterclockwise motion of the manual throttle control lever 3 may correspond to closing the throttle.

The engine 20 may be any type of engine in which the combustion of a fuel (e.g., gaseous fuel or liquid fuel) with an oxidizer (e.g., air) in a chamber applies a force to a drive component (e.g., piston, turbine, or another component) of the engine 20. The drive component rotates to turn a drive shaft.

The engine 20 may be four-stroke cycle engines, meaning four piston strokes make up a cycle. A compression cycle of the engine 20 includes an intake stroke, a compression stroke, a power stroke, and an exhaust stroke. During the intake stroke, the piston moves from the top of the cylinder to the bottom of the cylinder. A fuel and air mixture is forced by a pressure into the cylinder. Next, during the compression stroke, the piston moves back to the top of the cylinder, compression the fuel and air mixture into the cylinder head. The fuel is injected and/or atomized into the cylinder by a nozzle of the fuel injector. Next, during the power stroke, the compressed fuel and air mixture is ignited by a spark plug or heat source. The piston is pushed back down toward the bottom of the cylinder by the pressure. Finally, during the exhaust stroke, the piston returns to the top of the cylinder to expel the spent or combusted fuel and air mixture through an exhaust valve. In spark ignition engines, the air and fuel mixture is forced into the cylinder during intake and after the piston compresses the mixture, the spark ignites the mixture. The combustion from the spark causes gas to expand, which pushes the piston during the power stroke.

The liquid fuel may be gasoline, diesel, ethanol, or another example. The gaseous fuel may be liquefied petroleum gas (LPG), hydrogen gas, natural gas, biogas, or another gas. The LPG may be or include primarily butane, primarily propane, or a mixture of hydrocarbon gases. The hydrogen gas may include hydrogen mixed with air or oxygen. The hydrogen gas may be mixed with another fuel when delivered to the engine 20. Natural gas (e.g., compressed natural gas (CNG)) may be a hydrocarbon gas mixture. Biogas may be a gas produced by the breakdown of organic material.

The engine 20 may be used in a variety of devices including, but not limited to, chainsaws, lawn mowers, weed trimmers, all-terrain vehicles, wood splitters, pressure washers, garden tillers, snow blowers, a lawnmower, golf cart or other vehicles or devices.

The engine 20 may be liquid cooled or air cooled. In a liquid cooled engine, a radiator that houses cooling fluid that is pumped through the radiator. In an air cooled engine, one or more air paths through the engine that cool the engine. In some examples, the engine cylinder is cast with one or more fins that have a large surface area. As air blows across the cylinder and the fins, heat is removed from the engine.

Other systems in the engine 20 may include a fuel tank, a fuel line, a retractable starter, an air cleaning system, an exhaust system, a muffler, a control portion, a governor system, and a lubrication system. The retractable starter may include a recoil and a pull handle for starting the engine 20. The air cleaning system may including one or more filters for remove particles from the intake air for the engine 20. The muffler may receive exhaust air from the exhaust system including the byproducts of combustion in the engine 20. The muffler may reduce noise from the engine 20 and/or remove byproducts from the air. The governor system may regulate the throttle of the engine 20. The lubrication system may provide oil or another lubricant to the engine 20.

Figure 2:
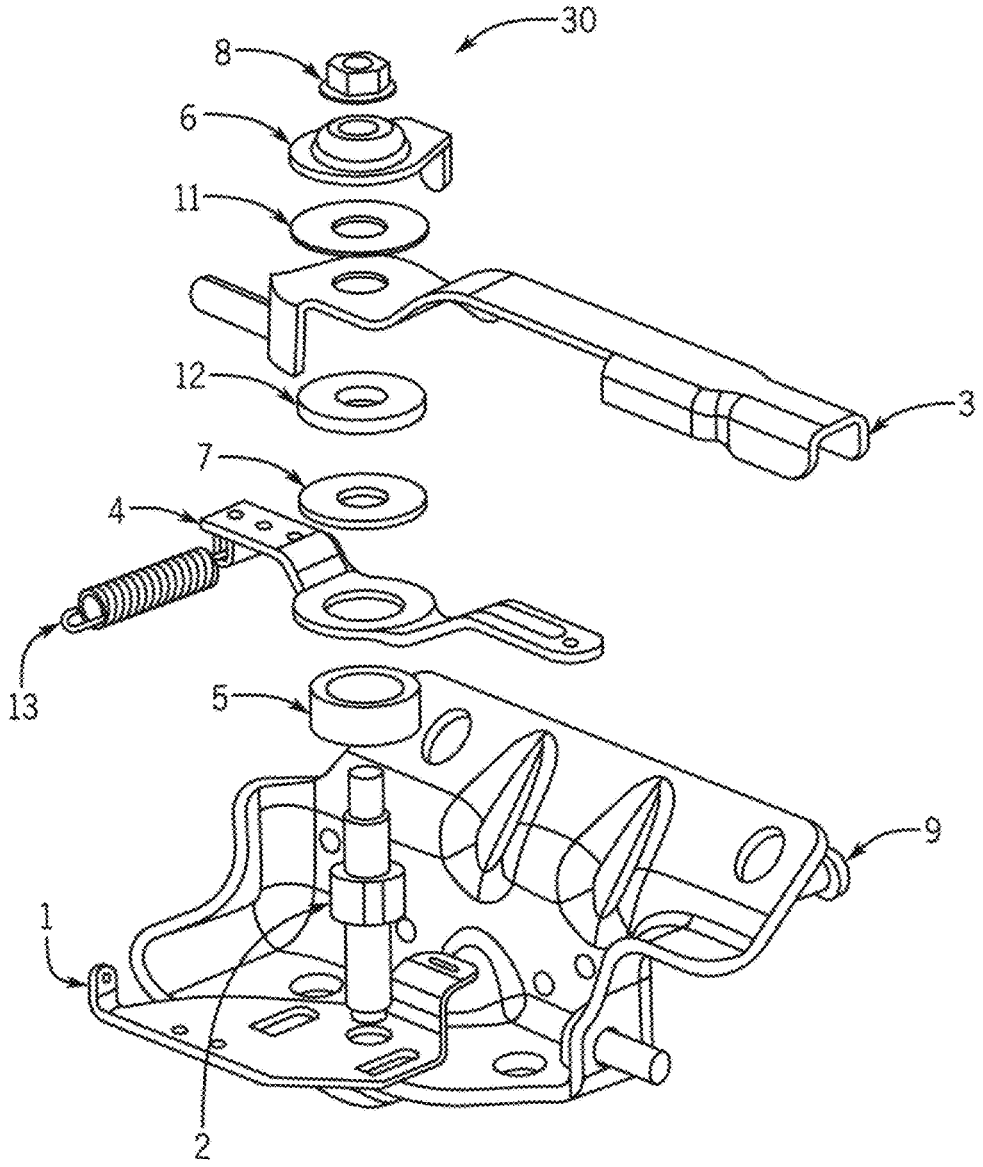
FIG. 2 illustrates an example throttle assembly including a remote throttle control lever and a manual throttle control lever.

FIG. 2 illustrates an example throttle assembly 30 including the remote throttle control lever 4 and the manual throttle control lever 3. The throttle assembly 30 may include a bracket 1, a control lever stud 2, the manual throttle control lever 3, the remote control throttle lever 4, a spacing washer 5, a control lever washer 6, a flat washer 7, a securing nut 8, a speed adjusting screw 9, a spring washer 11, a control lever washer 12, and the throttle return spring 13. The compression spring or governor spring 10 may also be included in the throttle assembly 30. Additional, different or fewer components may be included.

The bracket 1 mounts the throttle assembly 30 to the chassis of the engine 20. The bracket 1 may be formed of aluminum, steel, or another metal. The bracket 1 may include one or more holes for fasteners such as screws, bolts, or rivets that couple the throttle assembly 30 to the engine 20. The bracket 1 may include a mounting hole sized for the control lever stud 2. The control lever stud 2 may be a rod having one or more diameters shaped to couple the bracket 1 to the manual throttle control lever 3, the remote control throttle lever 4 and other components. The mounting hole may be aligned with the throttle plate or valve of the engine 20 such that when place the control lever stud 2 through the mounting hole, it is mechanically coupled with the throttle plate or valve. The control lever stud 2 may include ridges that are shaped to abut one or more other components such as the spacing washer 5, the control lever washer 6, the flat washer 7, and/or the securing nut 8.

The manual throttle control lever 3 also includes a mounting hole for the control lever stud 2. The control lever stud 2 supports the manual throttle control lever 3 in cooperation with the spring washer 11 and the control lever washer 12 under a pressing force from control lever washer 6 provided by the securing nut 8, which may be turned to tighten the fit of the manual throttle control lever 3. The manual throttle control lever 3 is configured to operate the throttle assembly and the engine 20 based on a force received from a user input at the input portion 31 of the manual throttle control lever 3.

In addition, the manual throttle control lever 3 includes an abutment portion 41. The abutment portion 41 of the manual throttle control lever 3 is spaced from the input portion 31 of the manual throttle control lever and configured to abut the remote control throttle lever 4. The abutment portion 41 is configured to restrict the motion of the remote control throttle lever 4. As the remote control throttle lever 4 is rotated counterclockwise (in the illustrated examples) under the force applied by the linkage 21 or the throttle return spring 13, the abutment portion 41 provides a stopper for the motion of the remote control throttle lever 4. The manual throttle control lever 3 is pressed by the spring washer 11 by enough force that it can stop at any location. The friction that holds the manual throttle control lever 3 in place is also sufficient to stop the movement of the remote control throttle lever 4.

The remote control throttle lever 4 also includes a mounting hole for the control lever stud 2. The remote control throttle lever 4 is configured to operate the throttle assembly 30 and the engine 20 based on a force received from an external device. The external device rotates the rotary bracket 22 and in turn, the linkage 21 to rotate the remote control throttle lever 4 to change the position of the throttle. The linkage 21, which may be a cable, is connected to the remote control throttle lever 4 at a connection point 42 (e.g., hole, hook, clip, or another mechanism).

The remote control throttle lever 4, while supported by the control lever stud 2 may be spaced from the spacing washer 5 and/or the flat washer 7 by a rotation space. The rotation space allows the remote control throttle lever 4 to rotate with respect to other components such as the manual throttle control lever 3. The remote control throttle lever 4 may rotate with respect to the other components with a moderate amount of force (e.g., 10 to 20 inch-pounds or 1.0 to 2.30 N-m). Examples for the rotation space may be 0.1 to 0.5 millimeters. The frictional force applied to the remote control throttle lever 4 is zero or negligible and much less than the frictional force applied to the manual throttle control lever 3 by the spring washer 11.

The governor spring 10, which is illustrated in FIG. 1, is a speed driving device attached to a governor system. The governor system provides spring force that tends to open the throttle to maintain the engine 20 at the desired speed when the operator adjusts the remote control throttle lever 4 as input to increase the spring force. The governor spring 10 may regulate the position of the remote control throttle lever 4 and/or the manual throttle control lever 3 according to the load on the engine 20. The governor spring 10 maintains the speed of the engine 20 (e.g., as set by the remote control throttle lever 4 and/or the manual throttle control lever 3) within a predetermined range as the load on the engine 20 varies. The length of the governor spring 10 length may be changed to set the engine speed and/or the predetermined range for the engine speed. The governor system may include one or more flyweights connected to the governor spring 10.

The throttle return spring 13 is configured to bias the remote control throttle lever against the abutment portion 41 of the manual throttle control lever 3 in an opposite direction of the force received from the external device through the rotary bracket 22 and linkage 21. In the example illustrated in FIGS. 1 and 2, the throttle return spring 13 provides a linear force that causes a torque in the counter clockwise direction on the remote control throttle lever 4. A resulting angular motion of the remote control throttle lever 4 in the counterclockwise direction, if the remote control throttle lever 4 moves, closes the throttle. The abutment portion 41 of the manual throttle control lever 3 stop the movement of the remote control throttle lever 4 according to the manually set position of the manual throttle control lever 3.

Figure 3:
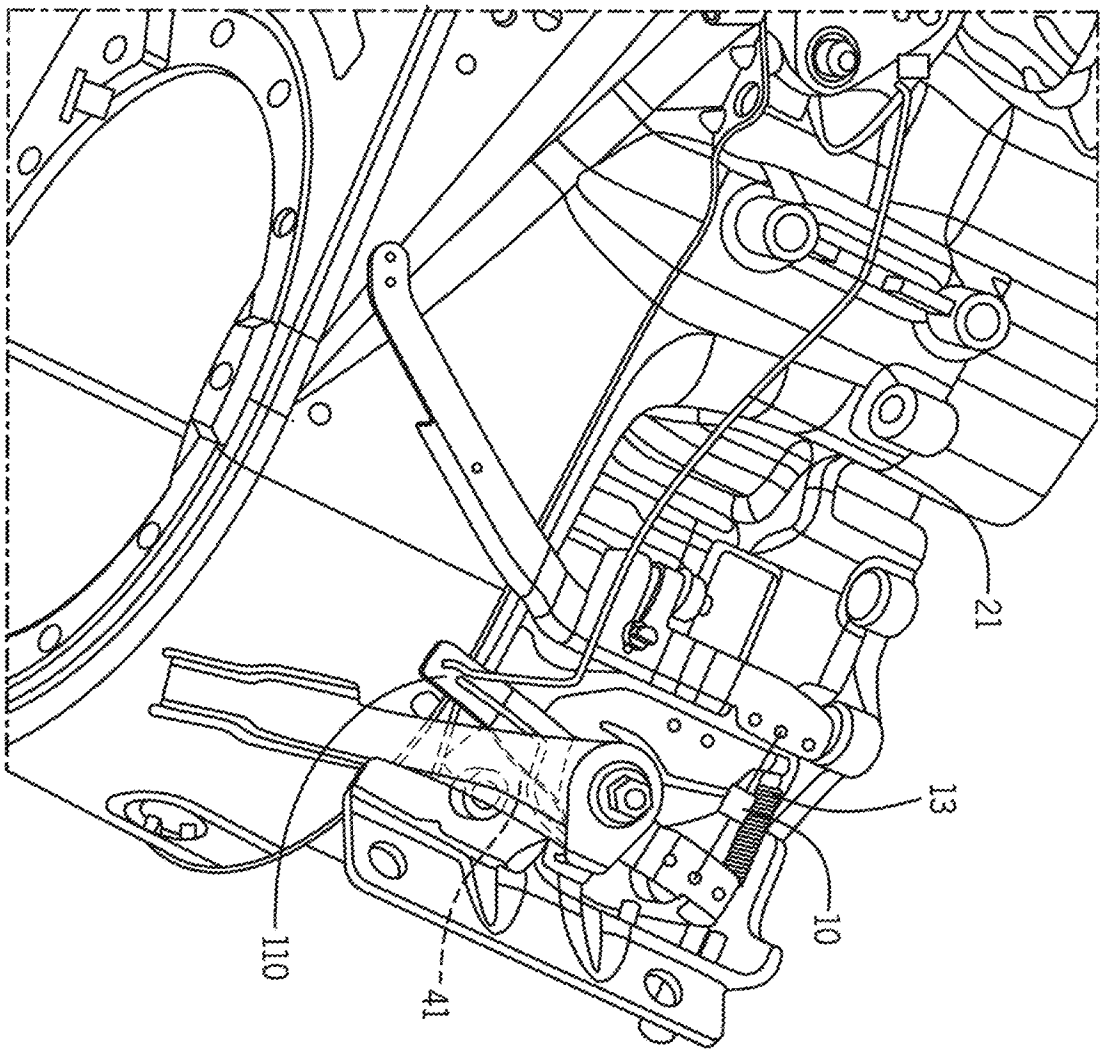
FIG. 3 illustrates an example operation for remote control operation of the engine.
Figure 4:
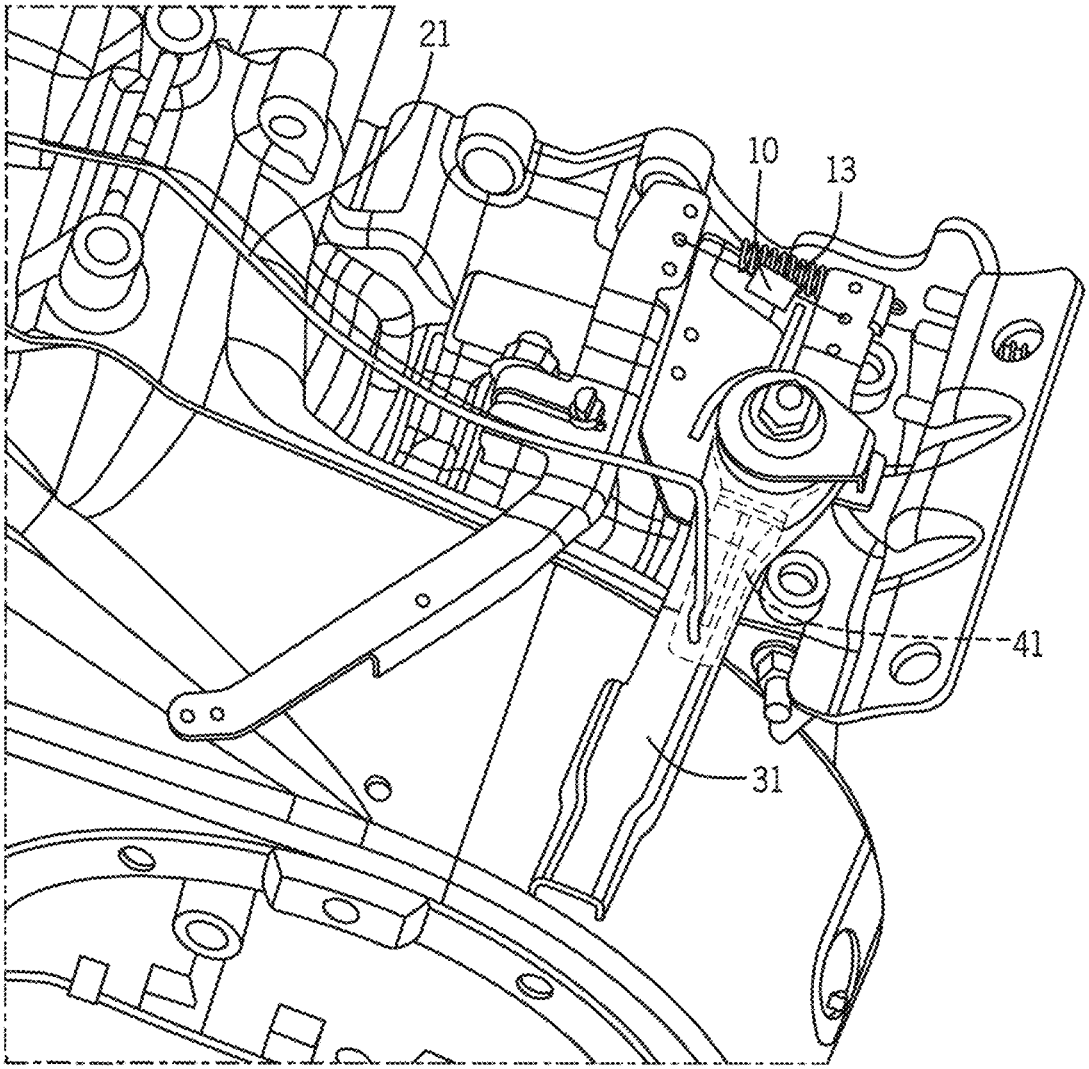
FIG. 4 illustrates an example operation for manual control operation of the engine.
Figure 5:
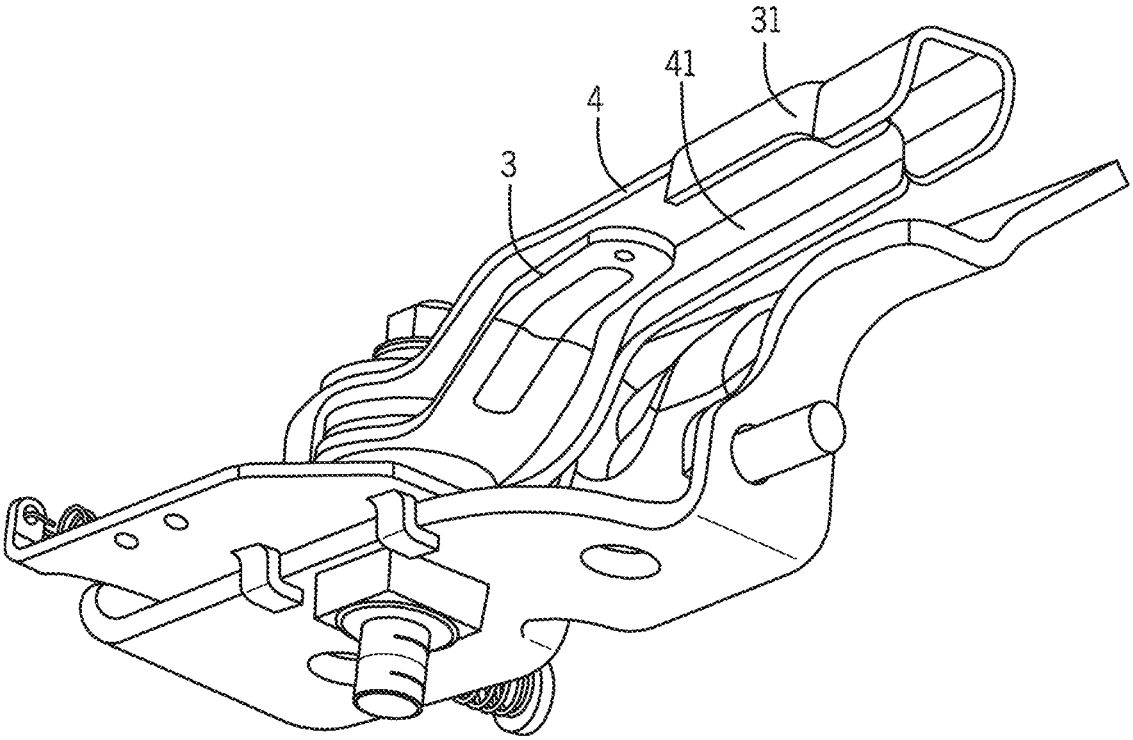
FIG. 5 illustrates a perspective view of the remote throttle control lever and the manual throttle control lever.
Figure 6:
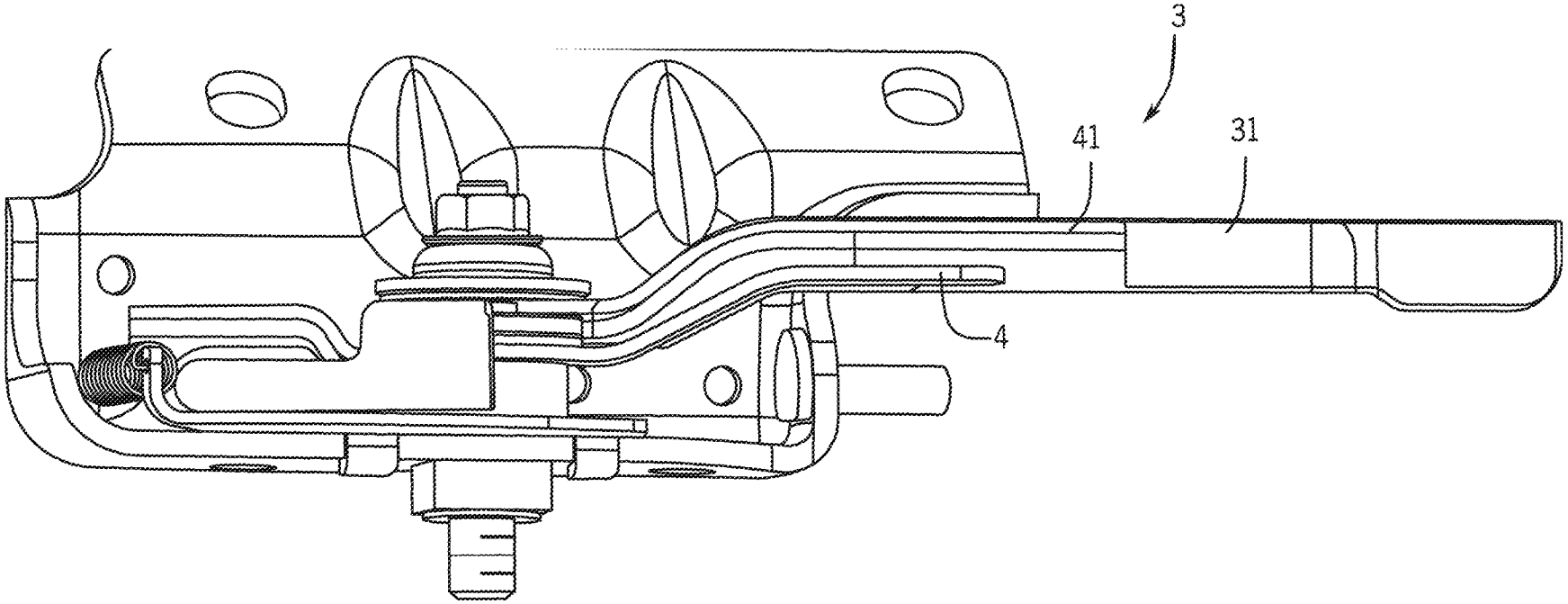
FIG. 6 illustrates the alignment of the remote throttle control lever and the manual throttle control lever.

FIGS. 3 and 4 illustrate the remote control operation and manual operation, respectively, of the throttle assembly 30. FIG. 5 illustrates a perspective view of the remote throttle control lever 4 and the manual throttle control lever 3. FIG. 6 illustrates the alignment of the remote throttle control lever 4 and the manual throttle control lever 3.

FIG. 3 illustrates an example operation for remote control operation of the engine 20. The remote control is the operation when the external device controls the speed of the engine 20. During remote control, the remote control throttle lever 4 controls the throttle assembly and the manual throttle control lever 3 serves as a minimum point for the rotation of the remote control throttle lever 4.

The manual throttle control lever 3 is manually set to a predetermined position. The predetermined position may be an idle speed setting, which is illustrated in FIG. 3. The external device moves the linkage 21, which may be a cable, and the remote control throttle lever 4 is rotated clockwise against the force of the throttle return spring 13. The movement of the remote control throttle lever 4 causes the throttle to open, or become more open, and accordingly, the speed of the engine 20 is increased.

When the linkage 21 stops pushing the remote control throttle lever 4 in the clockwise direction, that is, the linkage 21 is relaxed, and the throttle return spring 13 causes the remote control throttle lever 4 to return in the counterclockwise direction. This movement of the remote control throttle lever 4 causes the throttle to be closed or more closed, and accordingly, the speed of the engine 20 is decreased. The movement of the remote control throttle lever 4 is limited by the abutment portion of the manual throttle control lever 3.

FIG. 4 illustrates an example operation for manual control operation of the engine 20. The manual control is the operation when the user controls the speed of the engine 20. During manual control, the manual throttle control lever 3 controls the throttle assembly and the remote control throttle lever 4 rotates freely under the direction of the manual throttle control lever 3 and the throttle return spring 13.

The manual throttle control lever 3 is at a relaxed location such as the idle speed location, as illustrated in FIG. 4. The operator moves the manual throttle control lever 3 clockwise, which causes the remote control throttle lever 4 to rotate clockwise and also causes the throttle to open, or become more open. In addition, under the operator's force to move the manual throttle control lever 3 the throttle return spring 13 is stretched. The speed of the engine 20 is increased.

When the operator moves the manual throttle control lever 3 back toward the idle speed location, which is in the counterclockwise direction, the remote control throttle lever 4 is also moved in the counterclockwise direction. In one example, the manual throttle control lever 3 directly provides a force to the remote control throttle lever 4. In another example, the throttle return spring 13 provides the force to rotate the remote control throttle lever 4 in the counterclockwise direction, and the manual throttle control lever 3 allows the movement because the abutment portion 41 is moved out of the way of the remote control throttle lever 4.

Figure 7:
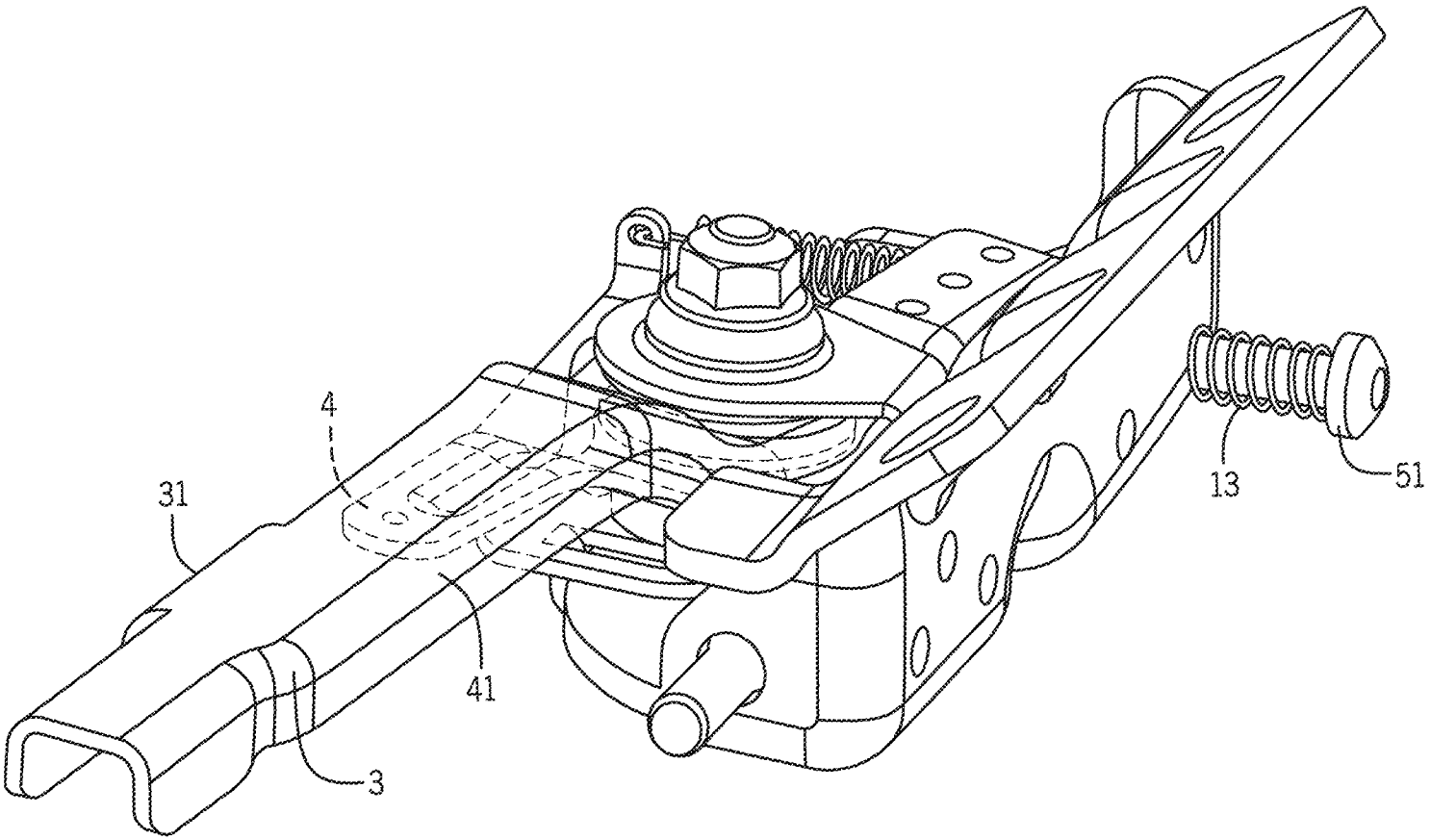
FIG. 7 illustrates the throttle assembly and a setting mechanism for the return spring.

FIG. 7 illustrates the throttle assembly and a setting mechanism 51 for the throttle return spring 13. The setting mechanism adjusts the displacement of the throttle return spring 13, which adjusts the throttle position, or the relationship between the throttle position and the remote control throttle lever 4 and/or the manual throttle control lever 3. For example, the setting mechanism may adjust the physical position of the manual throttle control lever 3 that corresponds to the idle speed setting. In another example, the setting mechanism 51 adjusts the relationship (e.g., displacement distance) between the governor spring 10 and the throttle assembly. Thus, the setting mechanism 51 adjusts the position of the throttle in relation to the throttle assembly 30. In one example, the setting mechanism 51 may include a screw that is made longer (e.g., screwed out of bracket 1) to decrease the displacement distance or tighten the throttle return spring 13 or made shorter (e.g., screwed into the bracket 1) to increase the displacement distance or increase the throttle return spring 13.

Figure 8:
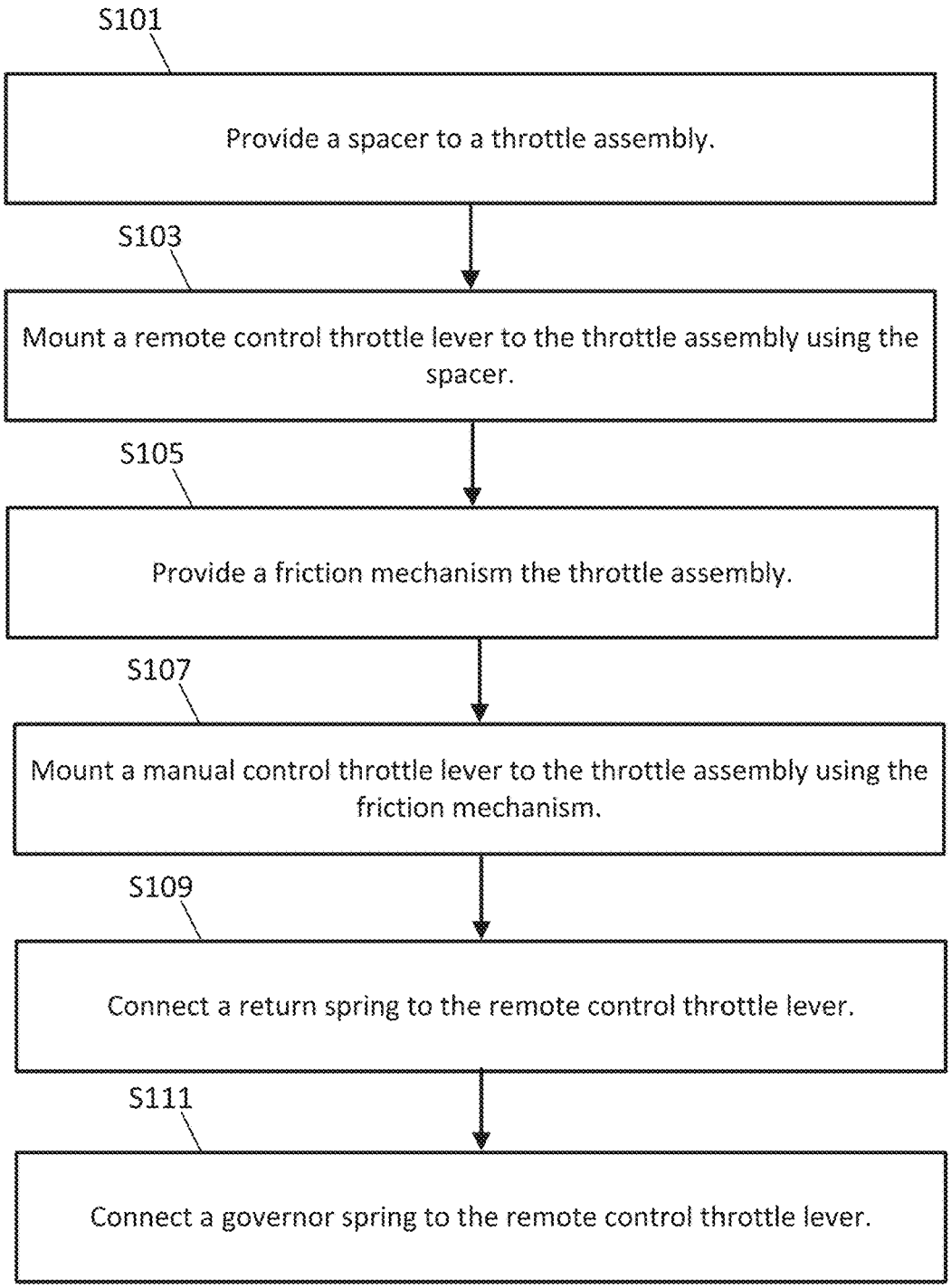
FIG. 8 illustrates an example flowchart for a process of manufacturing the throttle assembly.

FIG. 8 illustrates an example flowchart for a process of manufacturing the throttle assembly. Additional, different, or fewer acts may be included.

At act S101, a spacer is provided to a throttle assembly. The spacer may be one or more washers or other disks or rings that is placed onto a bolt or stud of the throttle assembly.

At act S103, a remote control throttle lever is mounted to the throttle assembly using the spacer. The remote control throttle lever is placed onto the bolt or stud of the throttle assembly. The spacer may have a predetermined dimension that is sufficient to space the remote control throttle lever from other components of the throttle assembly so that the remote control throttle lever can move freely with respect to the other components.

At act S105, a friction mechanism is provided to the throttle assembly. The friction mechanism may include one or more washers and a screw member. At act S107, a manual control throttle lever is mounted to the throttle assembly using the friction mechanism. The manual control throttle lever may be placed onto the bolt or stud of the throttle assembly. The friction mechanism may be tightened to the manual control throttle lever such that is does not move freely without manual operation.

At act S109, connect a first spring (e.g., return spring) to the remote control throttle lever. The first spring may bias the remote control throttle lever is a first direction to return the remote control throttle lever to press against the manual throttle control lever in a first direction.

At act S111, connect a second spring (e.g., governor spring) to the remote control throttle lever. The second spring may receive a force from the remote control throttle lever and apply the force to the throttle of the engine 20. The second spring may damper fluctuations in the remote control throttle lever and smooth out fluctuations caused by the load on the engine 20.

Figure 9:
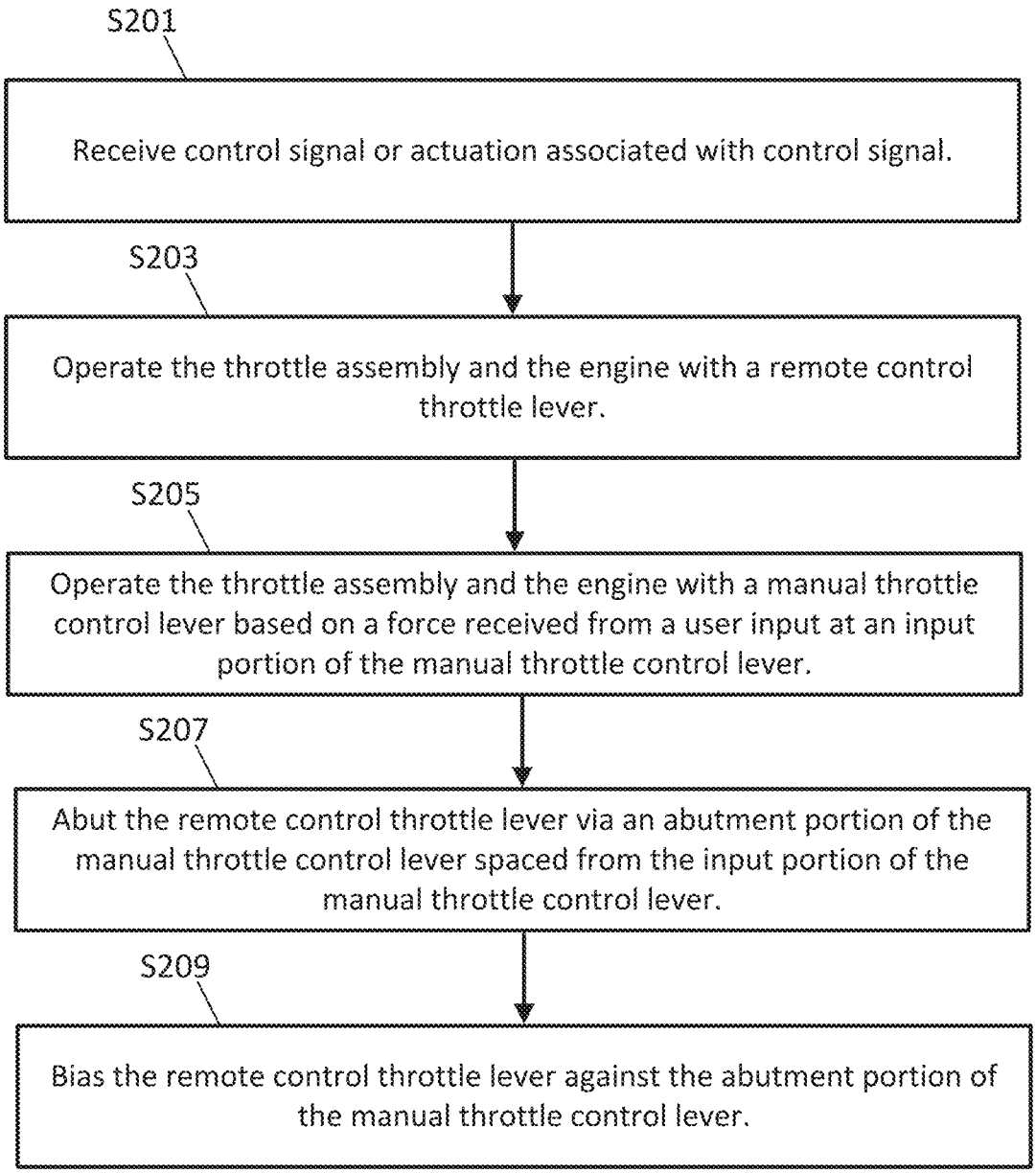
FIG. 9 illustrates an example flowchart for the remote control throttle lever and the manual control throttle lever.

FIG. 9 illustrates an example flowchart for the remote control throttle lever and the manual control throttle lever. Additional, different or fewer acts may be included.

At act S201, a control signal is generated or received for the operation of the remote control throttle lever 4. The control signal may operate a motor, a solenoid, or another mechanically driven device to actuate the remote control throttle lever 4. The mechanically driven device may be part of an appliance (e.g., chainsaws, lawn mowers, weed trimmers, all-terrain vehicles, wood splitters, pressure washers, garden tillers, snow blowers, etc.) with a coupling that connects to the engine 20. A controller may generate the control signal in according to one or more parameters for the appliance. The parameters may include an engine operation mode, a type of engine, a type of fuel, or a user selection. In another example, the control signal regulates a position of the remote control throttle lever 4 according to a load on the engine 20. Indirectly, the control signal regulates a position of the and the manual throttle control lever 3 according to the load on the engine 20.

At act S203, the throttle assembly operates the engine 20 with the remote control throttle lever 4 in response to the control signal. The remote control lever 4 may be rotated under the force of linkage 21 and/or the throttle return spring 13. The linkage rod 21 may provide a force in a first direction under the operation of the motor, the solenoid, or another mechanically driven device associated with the control signal described in act S203.

At act S205, the throttle assembly operates the engine 20 with the manual control throttle lever 3. The manual control throttle lever 3 may be moved by a user. However, the manual control throttle lever 3 moves only under a high frictional resistance so that the remote control lever 4 does not move the manual control throttle lever 3. The manual force received from the user is greater than the high frictional resistance of the manual control throttle lever 3.

At act S207, the manual control throttle lever 3 abuts the remote control throttle lever 4 through an abutment portion. The manual control throttle lever 3 may apply pressure to the remote control throttle lever 4 that overrides the setting for the remote control throttle lever 4 may through the linkage rod 21 and the control signal.

At act S209, the remote control throttle lever 4 is biased against the abutment portion of the manual throttle control lever 3. The throttle return spring 13 may provide the bias as a force in a second direction, opposite to the first direction. When the force from the linkage rod 21 is greater than the force from the throttle return spring 13, the throttle assembly moves in the first direction. When the force from the linkage rod 21 is less than the force from the throttle return spring 13, the throttle assembly moves in the second direction. The motion in the second direction may rotate the remote control throttle lever 4 against a spacing washer spaced from the manual control throttle lever.

The phrases "coupled with" or "coupled to" include directly connected to or indirectly connected through one or more intermediate components. Additional, different, or fewer components may be provided. Additional, different, or fewer components may be included.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

We claim:

1. A throttle assembly for an engine, the throttle assembly comprising:

a remote control throttle lever configured to operate the throttle assembly and the engine based on a force received from an external device;

a manual throttle control lever configured to operate the throttle assembly and the engine based on a force received from a user input at an input portion of the manual throttle control lever;

an abutment portion of the manual throttle control lever spaced from the input portion of the manual throttle control lever and configured to abut the remote control throttle lever; and a throttle return spring configured to bias the remote control throttle lever against the abutment portion of the manual throttle control lever in an opposite direction of the force received from the external device.

2. The throttle assembly of claim 1, further comprising:

a linkage rod coupled to the remote control throttle lever and the external device.

3. The throttle assembly of claim 1, wherein the external device includes a stepper motor or a solenoid.

4. The throttle assembly of claim 1, further comprising:

a controller configured to generate a control signal to operate the remote control throttle lever via the external device.

5. The throttle assembly of claim 1, further comprising:

a control lever configured to mount the remote control throttle lever and the manual throttle control lever to the engine.

6. The throttle assembly of claim 1, further comprising:

a spacing washer configured to provide a rotation space associated with the remote control throttle lever.

7. The throttle assembly of claim 6, wherein the rotation space allows the remote control throttle lever to rotate with respect to the manual throttle control lever.

8. The throttle assembly of claim 1, further comprising:

a governor spring configured to regulate a position of the remote control throttle lever and the manual throttle control lever according to a load on the engine.

9. The throttle assembly of claim 1, wherein the manual throttle control lever provides a minimum point for rotation of the remote control throttle lever.

10. A method for operating a throttle assembly of an engine, the method comprising:

operating the throttle assembly and the engine with a remote control throttle lever;

operating the throttle assembly and the engine with a manual throttle control lever based on a force received from a user input at an input portion of the manual throttle control lever;

abutting the remote control throttle lever via an abutment portion of the manual throttle control lever spaced from the input portion of the manual throttle control lever; and biasing the remote control throttle lever against the abutment portion of the manual throttle control lever.

11. The method of claim 10, further comprising:

translating a force from an external device through a linkage rod coupled to the remote control throttle lever.

12. The method of claim 11, wherein the external device includes a stepper motor or a solenoid.

13. The method of claim 12, wherein the force from the linkage rod is opposite of a direction that the remote control throttle lever is biased against the abutment portion.

14. The method of claim 12, further comprising:

generating a control signal to operate the remote control throttle lever via the external device.

15. The method of claim 11, further comprising:

rotating the remote control throttle lever against a spacing washer spaced from the manual control throttle lever.

16. The method of claim 11, further comprising:

regulating a position of the remote control throttle lever and the manual throttle control lever according to a load on the engine.

17. The method of claim 11, wherein the manual throttle control lever provides a minimum point for rotation of the remote control throttle lever.

18. A method of manufacturing a throttle assembly, the method comprising:

providing a spacer to the throttle assembly;

mounting a remote control throttle lever to the throttle assembly using the spacer;

providing a friction mechanism to the throttle assembly;

mounting a manual control throttle lever to the throttle assembly using the friction mechanism;

connecting a return spring to the remote control throttle lever; and connecting a governor spring to the remote control throttle lever.

19. The method of claim 18, further comprising:

providing a stud to the throttle assembly, wherein the spacer, the remote control throttle lever, and the manual control throttle lever are mounted to the stud.

20. The method of claim 18, further comprising:

connecting a linkage rod to the remote control throttle lever, wherein the linkage rod is configured to receive a force from an external device.

* * * * *